US005123142A

United States Patent [19]

Miller

[11] Patent Number: 5,123,142

[45] Date of Patent: Jun. 23, 1992

[54] VACUUM OPERATED CLEANER ATTACHMENT

[75] Inventor: Robert L. Miller, Henderson, Ky.

[73] Assignee: M and L Engineering, Inc., Henderson, Ky.

[21] Appl. No.: 588,756

[22] Filed: Sep. 27, 1990

[51] Int. Cl.[5] ..... A47L 9/06

[52] U.S. Cl. ..... 15/393; 15/234; 15/396; 15/415.1

[58] Field of Search ..... 15/393, 395, 396, 398, 15/399, 400, 415.1

[56] References Cited

U.S. PATENT DOCUMENTS

| | | | |
|---|---|---|---|
| 1,040,176 | 10/1912 | Eichele | 15/399 |
| 2,198,339 | 4/1940 | Hamilton | 15/395 |
| 2,214,989 | 9/1940 | Brand | 15/399 |
| 2,606,338 | 8/1952 | DeLorenzo | 15/395 |
| 4,972,541 | 11/1990 | Smith | 15/348 X |

FOREIGN PATENT DOCUMENTS

| | | | |
|---|---|---|---|
| 1400558 | 4/1965 | France | 15/398 |

*Primary Examiner*—Chris K. Moore
*Attorney, Agent, or Firm*—Warren D. Flackbert

[57] ABSTRACT

A cleaner attachment for use with a vacuum source, such as a common vacuum cleaner or a central vacuum system, defined by a plurality of feathers arranged about the end of a tube defining the body of the attachment. The feathered covered end of the tube includes a series of openings along both the side wall and the end wall thereof, creating a vacuum type atmosphere with the feathers. In a typical assembly, the quills of the feathers are wire wrapped into position on the tube, and the wire wrapping overlaid by a heat shrinking material.

4 Claims, 1 Drawing Sheet

VACUUM OPERATED CLEANER ATTACHMENT

BACKGROUND OF THE INVENTION

As is known, the cleaning of homes, offices, or the like, requires continual attention on the part of the occupant, where, particularly, even dusting sometimes presents a formidable, and yet delicate, activity. The invention satisfies the latter in presenting a cleaner attachment for a vacuum system in the form of a feather arrangement for dusting even the most fragile items.

SUMMARY OF THE INVENTION

More specifically, the cleaner attachment presented herein includes a display of feathers having the quill ends thereof secured to molded plastic tubing, where the tubing presents an arrangement of openings in the end portion thereof, i.e. both on the side wall and the end wall, to achieve a vacuum type atmosphere and ready dust particle pick-up after contact by the feathers. Basically the same invention accommodates connection with a common vacuum cleaner or a central vacuum system.

In any event, the cleaner attachment of the invention is readily manufactured, is light in weight for use, and affords ready disposition of dust or the like loosened by agitation of the feathers.

BRIEF DESCRIPTION OF THE DRAWING

A better understanding of the present invention will become more apparent from the following description, taken in conjunction with the accompanying drawing, wherein.

Figure 1:
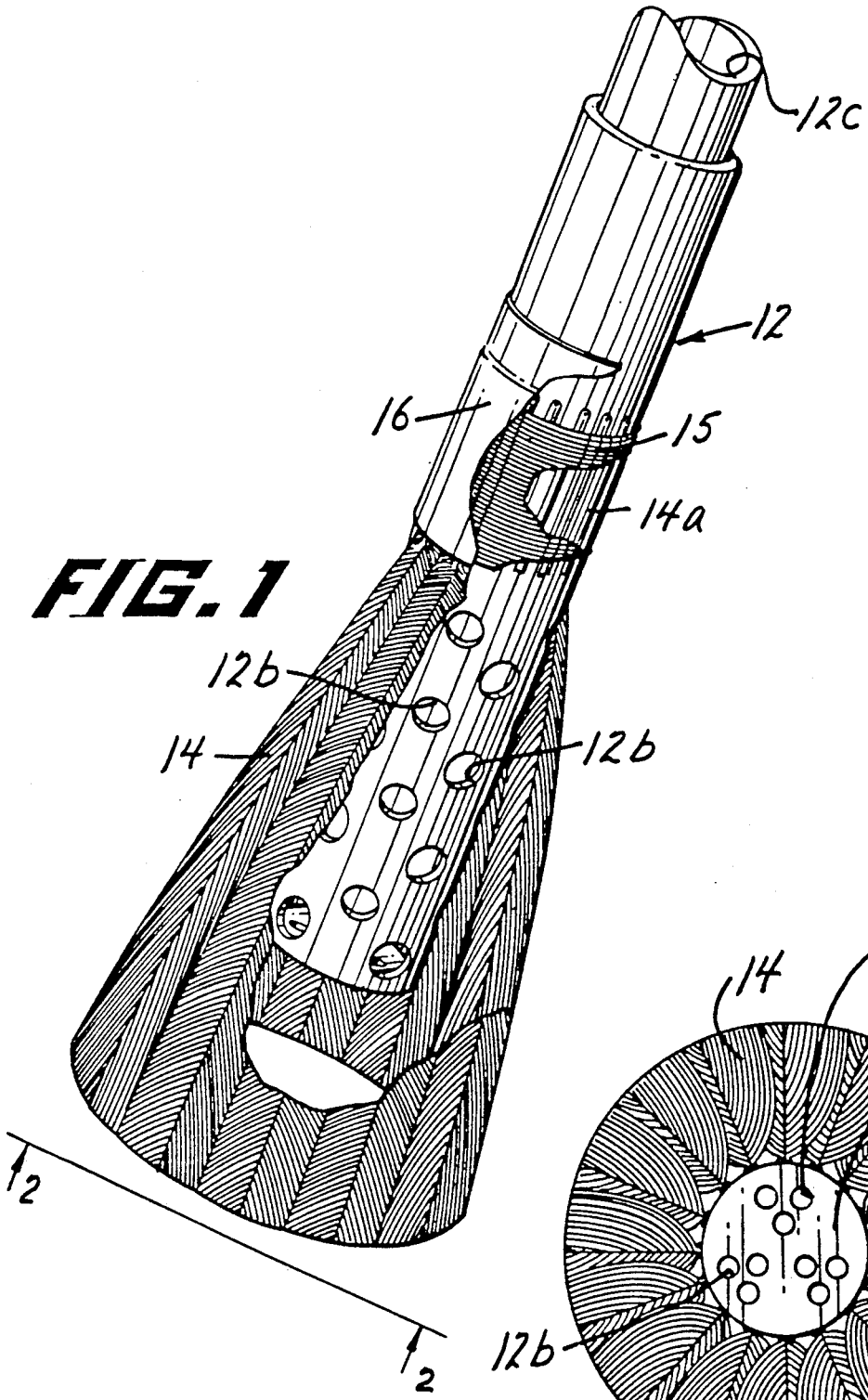
FIG. 1 is a perspective view of a vacuum operated cleaner attachment in accordance with the teachings of the present invention; and, FIG. 2 is an end view, taken at line 2—2 on FIG. 1 and looking in the direction of the arrows, further detailing the invention.

For the purposes of promoting an understanding of the principles of the invention, reference will now be made to the embodiment illustrated in the drawing and specific language will be used to describe the same. It will nevertheless be understood that no limitations of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF THE PREFERRED EMBODIMENT

Referring now to the, figures, the cleaner attachment includes an uninterrupted longitudinal hollow body 12 in the form of a tube been an end wall 12*a* and a side wall, and having an open opposite end 12*c*, typically fabricated from extruded AVS plastic resin. While not illustrated herein, the open end 12*c* of the tube 12 connects, through an appropriate fitting, such as 13, or the like, to a vacuum source as, for example, the hose of a common vacuum cleaner or a hose which communicates with an outlet in a central vacuum system.

Figure 2:
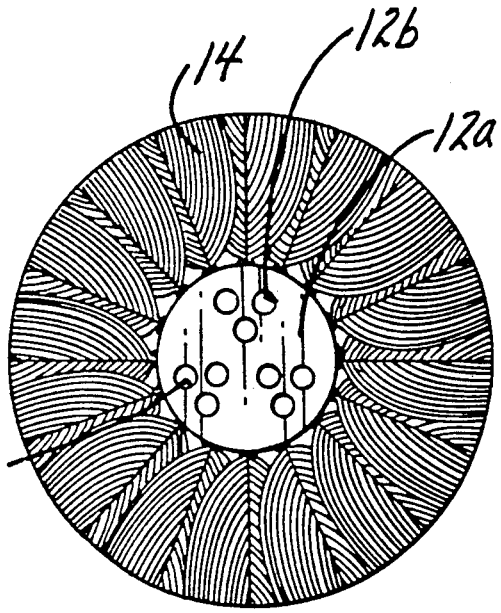

The end wall 12*a* of the tube 12, and the region of the body 12 side wall proximate such, include a plurality of openings 12*b* for achieving vacuum action. The openings 12*b* may be of any preselected size and assume any desired arrangement (compare FIG. 1 and FIG. 2, for example).

A series of feathers 14 extends along the tube 12 in an overlying relationship therewith. The feathers 14 are typically from a duck.

Each feather 14 includes a quill 14*a* (portion), where the mounting of the feathers 14 is typically accomplished by wrapping the quills 14*a* with wire 15 and, thereafter, overlaying such wire 15 with heat shrinkable material 16. In other words, the finished product presents a clean appearance and, additionally, a finished unit which is light in weight.

In use, the cleaner attachment is readily passed over the area and/or article being dusted and, with the aid of the vacuum, permits particle entry for passage to trash, where the feathers 14 serve effective loosening thereof. In other words, the attachment prevents damage during use and, at the same time, effective dust transfer. The openings 12*b* particularize the creation of a vacuum type atmosphere around each feather 14, allowing the aforesaid effective dusting.

It should be evident from the preceding that the cleaner attachment presented herein achieves superior results due, as stated, to the dust loosening properties achieved by the feathers 14, together with the vacuum atmosphere created through the openings 12*b*, both along the side and end walls of the tube 12.

The vacuum operated cleaner attachment described above is susceptible to various changes within the spirit of the invention, including, by way of example, in proportioning; the configuration of the openings; the method of securement of the feathers on the tube; and, the like. Thus, the preceding should be considered illustrative and not as limiting the scope of the following claims:

I claim:

1. A vacuum cleaner attachment comprising a body in the form of a continuous elongated tube having the same cross-section throughout the entire length thereof presenting a hollow uninterrupted passageway defined by a side wall and an end wall, and communicating with a vacuum source, a series of feathers longitudinally disposed along and around said tube, means securing said feathers in the same longitudinal direction onto the outer surface of said tube, and a series of openings arranged through said side wall of said tube beneath said feathers and directing air flow laterally through said feathers, where said openings communicate with said passageway within said tube and serve to distribute generally equalized lateral air flow directly through the area of said feathers into the portion of said tube beyond the points of attachment of said feathers.

2. The vacuum cleaner attachment of claim 1 where said securing means is a wire overlying quills of said feathers.

3. The vacuum cleaner attachment of claim 2 where heat shrinkable material overlies said wire.

4. The vacuum cleaner attachment of claim 1 where said feathers are duck feathers.

* * * * *